US005460390A

United States Patent [19]

Miller

[11] Patent Number: 5,460,390

[45] Date of Patent: Oct. 24, 1995

[54] SPARKING BRAKE PAD FOR IN-LINE ROLLER SKATES

[76] Inventor: Andrew Miller, 447 W. 50th St., New York, N.Y. 10019-6520

[21] Appl. No.: 167,761

[22] Filed: Nov. 18, 1993

Related U.S. Application Data

[63] Continuation of Ser. No. 906,531, Jun. 30, 1992, abandoned.

[51] Int. Cl.[6] ..... A63C 17/14

[52] U.S. Cl. ..... 280/11.2; 280/11.22; 446/23

[58] Field of Search ..... 280/11.2, 11.22, 280/87.042; 446/23; 188/251 R, 251 A, 251 M

[56] References Cited

U.S. PATENT DOCUMENTS

| | | | |
|---|---|---|---|
| 3,086,788 | 4/1963 | Vislocky | 280/11.37 |
| 3,580,595 | 5/1971 | Ware | 280/11.2 |
| 3,700,253 | 10/1972 | Heitfeild | 280/11.2 |
| 3,990,713 | 11/1976 | Hokanson | 280/87.042 |
| 4,040,638 | 8/1977 | Scardenzan | 280/87.042 |
| 4,280,935 | 7/1981 | Ogiwara | 188/73.1 X |
| 4,286,806 | 9/1981 | Bergstein | 280/816 |
| 4,394,037 | 7/1983 | Kuntz | 446/23 |
| 4,834,407 | 5/1989 | Salvo | 280/816 |
| 4,909,523 | 3/1990 | Olson | 280/11.2 |
| 5,048,897 | 9/1991 | Yeh | 280/87.042 X |
| 5,052,701 | 10/1991 | Olson et al. | 280/11.2 |
| 5,067,736 | 11/1971 | Olson et al. | 280/11.2 |

FOREIGN PATENT DOCUMENTS

| | | | |
|---|---|---|---|
| 414522 | 2/1991 | European Pat. Off. | 280/11.2 |
| 414521 | 2/1991 | European Pat. Off. | 280/11.2 |

*Primary Examiner*—David M. Mitchell
*Assistant Examiner*—Gary C. Hoge

[57] ABSTRACT

A sparking brake pad for use with an in-line roller skate is disclosed. The brake pad consists of a material having a high coefficient of friction and a flame retardant compound. A spark emitter is disposed within the brake pad such that when the brake pad is urged against a road surface it will reduce the speed of a roller skater and produce a burst of sparks.

1 Claim, 1 Drawing Sheet

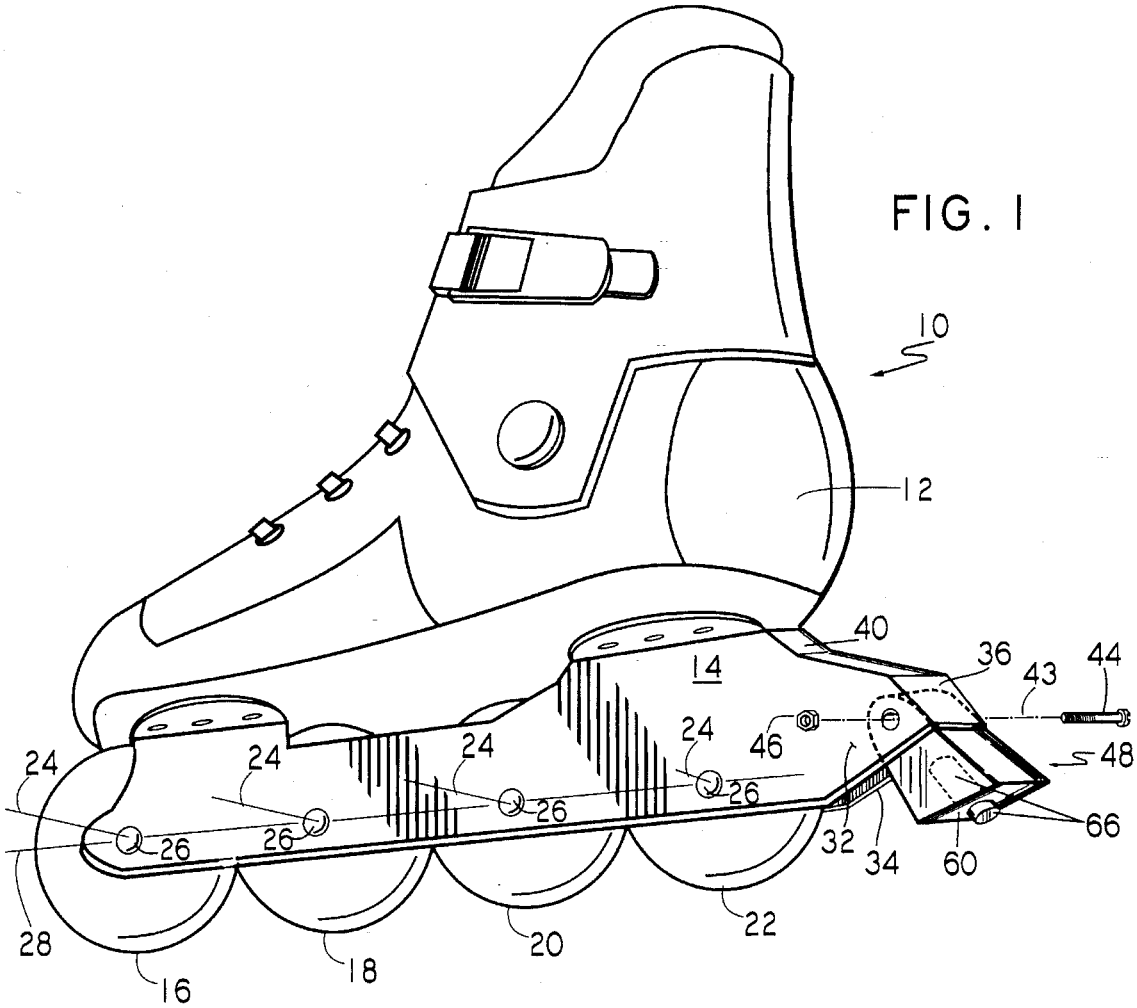
FIG. 1
FIG. 2
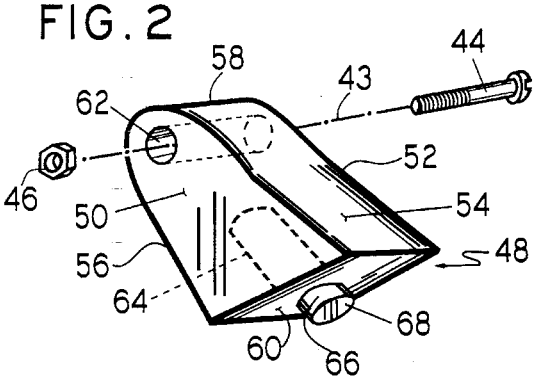
FIG. 3
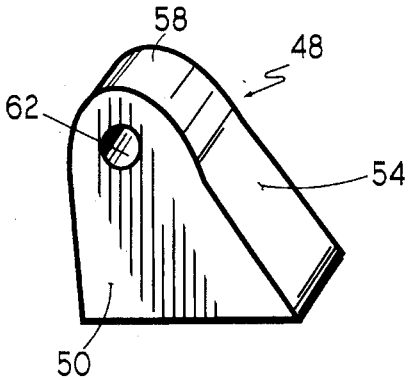
FIG. 4
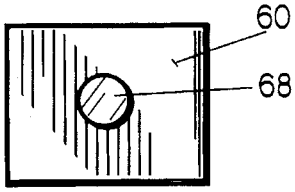

SPARKING BRAKE PAD FOR IN-LINE ROLLER SKATES

This application is a continuation of application Ser. No. 07/906,531, filed Jun. 30, 1992, now abandoned.

FIELD OF THE INVENTION

The present invention relates generally to in-line roller skates, and more particularly, to an improved brake pad for use with such skates.

BACKGROUND OF THE INVENTION

Roller skating has become a major outdoor recreational sport. Similar to other sports, roller skating also has inherent dangers. Many skaters are injured every year and a majority of the accidents are due to drivers of motor vehicles unintentionally striking the skaters. Roller skating safety has been partially solved with the implementation of various devices. These devices range from brake pads connected to the skate to help the skater to slowdown, knee and elbow protective gear, reflective patches and helmets containing elaborate electronics that provide flashes of light.

There are two main safety factors for outdoor roller skating. The first is a way in which to decelerate to a stop and the second is a way in which skaters can make themselves highly visible to the public.

Conventional roller skates utilize a toe mounted brake pad stopper on the front portion of the skate. For example, U.S. Pat. No. 3,700,253 discloses a toe stop which has a flat floor-engaging surface disposed at such an angle that it engages flat against the floor when the skate is tipped forwardly creating frictional contact with the surface traveled. However, with the recent popularity of in-line roller skates, the conventional skates are not used as frequently for outdoor skating making the toe stop mounting virtually obsolete.

In-line roller skates utilize two or more wheels positioned to rotate within a common, vertical plane. As disclosed for example, in U.S. Pat. Nos. 5,067,736 and 5,052,726, in-line roller skates can have a brake pad member positioned behind the rear wheel formed from a synthetic material having a high coefficient of friction. When the roller skate is pivoted rearwardly about the rear most axle bringing the brake pad base into frictional contact with the road surface, it creates resistance between the two, which in turn reduces the speed of the roller skater.

Although the available in-line skate brake pad efficiently slows the skater to a stop, this method of design does not indicate to persons of close proximity to the skater that the skater wishes to decelerate or stop. There is no real audible or visual means implemented during the stopping action of the current mentioned brake pads to warn persons or vehicles of close proximity to the skater.

The combination of a spark generating attachment with conventional roller skates is known in the art. For example, U.S. Pat. Nos. 4,286,806 and 3,086,788 disclose a spark generating attachment for conventional roller skates. Although these are an excellent idea for a visual display the designs are for conventional roller skates and will not work with the new in-line roller skates. In addition, these spark generating attachments are antiquated, complicated in design and expensive to manufacture. Most importantly, they are not in any way combined in a brake pad and do not aid the skater in decelerating to a stop.

While the prior art mentioned above may accomplish their original objectives they suffer from a number of disadvantages:

(a) The conventional roller skate brake pad does not fit the new more popular outdoor in-line roller skate.

(b) The prior art in-line skate brake pad does not provide an audible or visual means in which to alert others of the roller skater's intentions to reduce speed or stop.

(c) The spark generating attachments mentioned above are designed for conventional roller skates and for aesthetic purposes only. In addition, they are complicated to use and manufacture and in no way do they assist the skater in slowing down or stopping.

SUMMARY OF THE INVENTION

The present invention is directed to a spark emitting brake pad which is mounted at the rear of an in-line roller skate. A flint rod or other suitable spark emitter is mounted within the brake pad body such that when the brake pad is urged against a road surface it will reduce the speed of the roller skater and produce a burst of sparks to alert others in the skater's vicinity of the skater's intention to decelerate or stop. The brake pad body is composed of a relatively hard material having a high coefficient of friction and a flame retardant compound. The flame retardant compound reduces any combustion of abraded brake pad particles when they are introduced into the stream of sparks created by the spark emitter when the brake pad is pressed against the road surface. The sparking brake pad is removably secured to a brake pad housing and can be easily replaced when worn out.

Accordingly, one object of the present invention is to provide an in-line roller skate sparking brake pad which includes a body of material having a high coefficient of friction and a spark emitter secured thereto to visually alert persons of the roller Skater's presence and intention to reduce speed or stop.

Another object of the present invention is to provide a roller skate sparking brake pad with a self-contained light emitting source that fits in-line roller skates which can be installed and replaced with ease as well as convenient to use.

Yet another object of the present invention is to provide a roller skate brake pad with a self contained light emitting source that is selectively engagable and durable under normal and extreme operating conditions, such as the forces encountered with children and adult usage.

A further object of the present invention is to provide a roller skate brake pad with a self contained light emitting source of simple design (i.e., does not incorporate the use of batteries, bulbs or phosphorescent chemicals) and is inexpensive to manufacture.

Another object of the present invention is to provide a roller skate brake pad with a self contained light emitting source that is not unreasonably dangerous.

These and other objects and advantages of the present invention will appear more fully from the following description made in conjunction with the accompanying drawings which are merely illustrative of such invention.

BRIEF DESCRIPTION OF THE DRAWINGS

FIG. 1 is a side perspective view of an in-line roller skate which utilizes the sparking brake pad according to the present invention.

FIG. 2 is a perspective view of the sparking brake pad of the present invention.

FIG. 3 is a side perspective view of the sparking brake pad of the present invention.

FIG. 4 is a bottom view of the sparking brake pad of the present invention.

DETAILED DESCRIPTION OF THE INVENTION

Referring now to FIGS. 1–4, there is shown an in-line roller skate 10 which includes a boot 12 for wear by a skater, and a strong, lightweight, molded roller skate frame 14 which can be formed of synthetic material and carried by boot 12. A plurality of wheels, here shown in FIG. 1 as wheels 16, 18, 20 and 22 are rotatably mounted to frame 14 for rotation about a plurality of axles having parallel axes 24, each of the wheels being mounted to the frame by pivots 26 or the like which serve as axles. The frame 14 will normally carry three to five wheels, and frames having up to five wheels or more are within the purview of the present invention.

As shown in FIG. 1, each of the wheels 16, 18, 20 and 22 has its central axis in a common plane 28 which is substantially parallel to a road surface (not shown) and all the wheels can engage the road surface during coasting. Some four wheeled in-line skates are structured to have their intermediate wheels positioned lower than the front and rear wheels, and utilize only the intermediate wheels as coasting wheels. These skates may be used with the sparking brake pad described herein and are within the purview of the present invention. An example of an in-line roller skate 10 and associated boot 12 which can be used in accordance with the sparking brake pad of the present invention is described in U.S. Pat. No 5,052,701 and is incorporated herein by reference.

The term "road surface" as used herein is not limited to actual road surfaces but encompasses any usable surface on which roller skating can be done, including without limitation, roads, sidewalls, decks or the like, including indoor and outdoor abrasive surfaces.

A brake pad housing 30 is located at the rear end of frame 14 and includes first and second lateral sidewalls 32 and 34, a rear wall 36 and a cap 38 which joins the transverse surface 40 of the frame 14. A screw aperture 42 passes through lateral sidewalls 32 and 34 and is adapted to receive a screw 44 having threads for receiving a nut 46. The screw apertures 42 are substantially coaxial with their common axis 43 being substantially parallel to the wheel axes 24. It should be understood that other suitable fasteners can be used in place of screw 44 and nut 46.

Although the brake pad housing 30 has been shown as being an integral part of frame 14, it should be understood that the housing could be a separate housing unit mounted at the rear of skate frame 14. Furthermore, it should be understood by a person of ordinary skill in the art of the present invention that the position of apertures 42 may be located in a different location so as to access the brake pad housing 30 in a specific manner.

As best shown in FIG. 4, the sparking brake pad 48 of the present invention has a generally rectangular cross-section as viewed from below and the cross-section may be square, cylindrical or elongated depending on which particular in-line roller skate brake pad housing it is designed for. The pad 48 includes first and second lateral side faces 50 and 52, a front face 54, a rear face 56, an upper face 58 and a base 60. The base 60 has a substantially flat surface which is angled such that it can be held against a road surface with the flat base surface 60 being in full facial engagement with the road surface when the skate is tilted rearward. The upper face 58 can be an arcuate shape and have a substantially uniform radius of curvature.

The brake pad 48 further includes a first hollow bore 62 and a second hollow bore 64 which do not come into contact with each other. The first bore 62 is substantially coaxial with the common axis 43 of apertures 42 to define a continuous passage through the sidewalls 32, 34 and the brake pad 48 so that the sparking brake pad 48 can be securely retained within brake pad housing 30, between sidewalls 32 and 34 by the screw 44 and nut 46. Thus, the sparking brake pad 48 mounts effortlessly into the existing roller skate brake pad housing 30 with a single fastener 44. This mounting design enables the roller skater to easily replace a worn pad with a new pad, ensuring continued safety for the skater.

A spark emitter 66 is disposed within the second bore 64. The bore 64 which can be for example, cylindrical, surrounds and encases spark emitter 66 and can be perpendicular to the first bore 62. The spark emitter 66 can be positioned perpendicular to base 60 of brake pad 48. The spark emitter 66 can be secured within second bore 64 of brake pad 48 by insert molding, a suitable adhesive or any other suitable means. The spark emitter 66 can consist of material compounds which produce a multitude of sparks effortlessly when frictionally engaged with an abrasive surface. For example, the spark emitter 66 can be a flint rod or other suitable spark producing element.

The sparking brake pad 48 is a molded body of rubber or synthetic material possessing a high coefficient of friction to achieve efficient braking action when the pad is urged against a road surface such as when a roller skater pivots the roller skate 10 rearwardly. In addition, the material of the brake pad 48 includes a flame retardant compound such as antimony oxide or a compound with similar flame retarding properties. The addition of a flame retardant compound to the brake pad material reduces the amount of combustion of abraded brake pad particles from the brake pad 48 when particles are introduced into the stream of sparks created by the spark emitter 66 when brake pad 48 is urged against the road surface during roller skating braking action.

The manner of using the sparking brake pad 48 is similar to that of conventional brake pads for in-line roller skates which are in current use. Namely, a roller skater pivots the roller skate 10 rearwardly thereby bringing the base 60 of brake pad 48 and an exposed end 68 of flint rod 66 into contact with the road surface. The exposed end 68 of the spark emitter 66 and the base 60 are then frictionally engaged with the road surface. This frictional encounter will not only reduce the speed of the skater but will simultaneously produce bright bursts of sparks to create a visual warning signal. It should be noted that although FIGS. 1 and 2 show the exposed end 68 of spark emitter 66 as protruding from base 60, in use, exposed end 68 will be flush with the flat surfaced base 60 due to wear from contacting the road surface. In addition, since the exposed end 68 and the base 60 will contact the road surface simultaneously during braking, each of these surfaces will wear substantially simultaneously.

Accordingly, the sparking brake pad of the present invention provides a highly reliable, lightweight (approximately 1 ounce per unit), economical (easily manufactured at a low cost) device that produces a bright warning light and decelerates the roller skater when the device is urged against a road surface. The sparking brake pad of the present invention is a self contained light emitting source that is selectively engaged and durable under normal and extreme operating conditions such as forces encountered with children and adult usage.

While the invention has been particularly shown and described with respect to the illustrative and preferred embodiments thereof, it will be understood by those skilled in the art that the foregoing and other changes in form and details may be made therein without departing from the spirit and scope of the invention which should be limited only by the scope of the appended claims.

What is claimed is:

1. A spark emitting brake pad for roller skates comprising:

(a) a rubber-like material with a high coefficient of friction which includes a hollow bore recess on its underside, and (b) a spark emitter element which fastens into said hollow bore recess, and (c) a chemical additive means admixed with said rubber-like material for inhibiting combustion of said material.

* * * * *